US007628898B2

(12) United States Patent
Klocke et al.

(10) Patent No.: US 7,628,898 B2
(45) Date of Patent: Dec. 8, 2009

(54) METHOD AND SYSTEM FOR IDLE STATE OPERATION

(75) Inventors: John Klocke, Kalispell, MT (US); Kyle M. Hanson, Kalispell, MT (US); Rajesh Baskaran, Kalispell, MT (US)

(73) Assignee: Semitool, Inc., Kalispell, MT (US)

( * ) Notice: Subject to any disclaimer, the term of this patent is extended or adjusted under 35 U.S.C. 154(b) by 897 days.

(21) Appl. No.: 11/198,905

(22) Filed: Aug. 5, 2005

(65) Prior Publication Data

US 2006/0032758 A1 Feb. 16, 2006

Related U.S. Application Data

(63) Continuation-in-part of application No. 10/688,420, filed on Oct. 16, 2003, now abandoned, and a continuation-in-part of application No. 10/861,899, filed on Jun. 3, 2004, which is a continuation-in-part of application No. 10/729,349, filed on Dec. 5, 2003, now Pat. No. 7,351,314, which is a continuation-in-part of application No. 10/729,357, filed on Dec. 5, 2003, now Pat. No. 7,351,315, which is a continuation-in-part of application No. 09/804,697, filed on Mar. 12, 2001, now Pat. No. 6,660,137.

(51) Int. Cl.
*C25D 17/02* (2006.01)
*C25D 21/00* (2006.01)
*C25D 7/12* (2006.01)

(52) U.S. Cl. ..... 204/237; 204/263

(58) Field of Classification Search ..... None
See application file for complete search history.

(56) References Cited

U.S. PATENT DOCUMENTS 5,883,762 A 3/1999 Calhoun et al.
6,527,920 B1 3/2003 Mayer et al.
6,602,394 B1 8/2003 Hillebrand
6,660,137 B2 12/2003 Wilson et al.
6,755,960 B1 6/2004 Frischauf et al.
6,852,209 B2 * 2/2005 Kovarsky ..... 205/148
6,916,412 B2 * 7/2005 Woodruff et al. ..... 205/97
7,351,315 B2 * 4/2008 Klocke et al. ..... 204/232
7,427,338 B2 * 9/2008 Dordi et al. ..... 204/261
2003/0038035 A1 * 2/2003 Wilson et al. ..... 205/96
2004/0000491 A1 1/2004 Kovarsky et al.
2004/0016636 A1 1/2004 Yang et al.
2004/0118694 A1 6/2004 Yang et al.
2005/0081744 A1 4/2005 Klocke et al.
2005/0087439 A1 4/2005 Hanson et al.
2005/0121317 A1 6/2005 Klocke et al.
2007/0043474 A1 * 2/2007 Klocke ..... 700/266

* cited by examiner

*Primary Examiner*—Harry D Wilkins, III
(74) *Attorney, Agent, or Firm*—Christensen O'Connor Johnson Kindness PLLC; Jeffrey M. Sakoi; Craig E. Bohn

(57) ABSTRACT

Methods and systems for electrochemically processing microfeature workpieces are described herein. In one embodiment, a process for electrochemically treating a surface of a plurality of microfeature workpieces in an electrochemical treating chamber that includes a processing unit separated from an electrode unit by an ion-permeable barrier is described. The process involves an idle stage wherein during the idle stage, processing fluid components are prevented from transferring between the first processing fluid and the second processing fluid. The described system includes a flow control system for controlling the flow of processing fluid to achieve separation of a processing fluid from the barrier during the idle stage.

7 Claims, 7 Drawing Sheets

METHOD AND SYSTEM FOR IDLE STATE OPERATION

CROSS-REFERENCES TO RELATED APPLICATIONS

This application is a continuation-in-part of application Ser. No. 10/688,420, filed on Oct. 16, 2003, now abandoned which published on Apr. 21, 2005, as publication No. US 2005/0081744 A1 and is a continuation-in-part of prior application Ser. No. 10/861,899, filed on Jun. 3, 2004, and published on Apr. 28, 2005, as publication No. US 2005/0087439 A1, which in turn is a continuation-in-part of U.S. application Ser. No. 10/729,349, filed Dec. 5, 2003, now U.S. Pat. No. 7,351,314 which was published on Jun. 9, 2005, as U.S. Publication No. US 2005/0121317 A1, which in turn is a continuation-in-part of application Ser. No. 10/729,357, filed on Dec. 5, 2003, now U.S. Pat. No. 7,351,315 and published on Jun. 9, 2005, as publication No. US 2005/0121326 A1, which in turn is a continuation-in-part of application Ser. No. 09/804,697, filed on Mar. 12, 2001, now U.S. Pat. No. 6,660, 137. Each of the above prior applications and patents is incorporated herein by reference in their totality.

FIELD OF THE INVENTION

This application relates to systems and methods for electrochemically processing microfeature workpieces having a plurality of microdevices integrated in and/or on the workpiece. The microdevices can include submicron features. Particular aspects of the present invention are directed toward methods for electrochemically processing microfeature workpieces in an electrochemical treating chamber that employs a barrier to separate a first processing fluid from a second processing fluid. An additional aspect of this application is directed to a chamber for electrochemically treating a microfeature workpiece that includes a flow control system for controlling a first processing fluid circulation system or a second processing fluid circulation system to cause processing fluid to separate from a barrier between the two processing fluids.

BACKGROUND OF THE INVENTION

Microelectronic devices, such as semiconductor devices, imagers, and displays, are generally fabricated on and/or in microelectronic workpieces using several different types of machines, otherwise known as tools. Such processing machines often include a plurality of processing stations that perform the same procedures on a plurality of workpieces. Other processing machines include a plurality of processing stations that perform a series of different procedures on individual workpieces or batches of workpieces. For example, these processing stations can be used to carry out electroplating, electrophoretic deposition, electroetching, electropolishing, anodization, or electroless plating procedures. In a typical fabrication process, one or more layers of conductive materials are formed on the workpieces during deposition stages. The workpieces are then typically subjected to etching and/or polishing procedures (e.g., planarization) to remove a portion of the deposited conductive layers and form electrically isolated contacts and/or conductive lines.

Tools that plate, etch, polish and anodize metals or other materials on workpieces are becoming an increasingly useful type of processing machine. These procedures can be used to process copper, solder, gold, silver, platinum, nickel, metal alloys, and other materials that are useful in the manufacture of microfeature workpieces. For example, a typical copper plating process involves depositing a copper seed layer onto the surface of a workpiece using chemical vapor deposition (CVD), physical vapor deposition (PVD), electroless plating processes, or other suitable methods. After forming the seed layer, a blanket layer or patterned layer of copper is plated onto the workpiece by applying an appropriate electrical potential between the seed layer and an anode in the presence of an electroprocessing solution. The workpiece is then cleaned, etched, and/or annealed in subsequent procedures.

In U.S. Application Publication No. 2005/0087439 A1, from which the present application claims priority, it is proposed to employ an electrochemical deposition chamber with a non-porous barrier separating processing fluids. The described chamber is divided into two distinct systems that interact with each other to electroplate a material onto the workpiece while controlling migration of selected components in the processing fluids (e.g., organic additives) across the non-porous barrier. Materials that can be electroplated onto the workpiece include metals that can be placed into an ionic form in the processing fluids. For example, copper, solder, gold, silver, platinum, nickel, metal alloys, and other metals can be deposited onto the workpiece.

A schematic illustration of an electrochemical deposition chamber 10 of application Ser. No. 2005/0087439 A1 is illustrated in FIG. 1. Chamber 10 includes a processing unit 12 that provides a first processing fluid 14, (e.g., a catholyte) to a workpiece 16 (i.e., working electrode), and an electrode unit 18 that provides a second processing fluid 20 (e.g., anolyte) different than the first processing fluid 14, and an electrode 22 (i.e., counterelectrode). The catholyte typically contains components in the form of ionic species such as acid ions and metal ions. The catholyte also includes other components, such as accelerators, suppressors, and levelers which improve the results of the electroplating process. The anolyte includes ionic components such as acid ions and metal ions. Unlike the catholyte, the anolyte typically does not include organic components. Chamber 10 also includes a non-porous barrier 24 between the first processing fluid 14 and the second processing fluid 20. Non-porous barrier 24 allows ions (e.g., $H^+$ and $Cu^{+2}$) to pass through the barrier, but inhibits organic components (e.g., accelerators, suppressors, and levelers) from passing between the first and second processing fluids. As such, non-porous barrier 24 separates components of the first and second processing fluids from each other such that the first processing fluid can have different chemical characteristics than the second processing fluid. As explained above, the first processing fluid can be a catholyte having organic components and the second processing fluid can be an anolyte without organic components or a much lower concentration of such components. The first processing fluid may also contain metal ions and acid ions at different concentrations than the second processing fluid.

The non-porous barrier of U.S. Application Publication No. 2005/0087439 A1 provides several advantages by substantially preventing the organic components in the catholyte from migrating to the anolyte. First, because organic components from the catholyte are prevented from transferring to the anolyte, they cannot flow past the anode and decompose into products that may interfere with the plating process. Second, because the organic components do not pass from the catholyte to the anolyte and then decompose at the anode, they are consumed at a slower rate so that it is less expensive and easier to control the concentration of organic components in the catholyte. Third, less expensive anodes, such as pure copper anodes or bulk copper material, can be used in the anolyte because the risk of passivation by reaction of the anode with organic components is reduced or eliminated.

As effective as these electrochemical treatment chambers are as processing machines in the fabrication of microelectronic devices on and/or in microelectronic workpieces, for numerous reasons, the chambers are not typically run around the clock. For example, the need to operate the chambers depends on many factors, including the ability of upstream processes to provide a supply of microelectronic workpieces suitable for processing in the electrochemical treatment chambers. When microelectronic workpieces are not available for processing in the electrochemical treatment chambers, the chambers must sit idle.

A drawback of allowing the electrochemical treatment chamber to sit idle without an electric potential provided between the working electrode and the counterelectrode is that the concentration of acid ions and the concentration of metal ions in the catholyte and anolyte can change. In some situations, the change causes the acid ion and metal ion concentration to fall outside of the process specifications. Restarting the electrochemical process with the processing fluids out of specification can result in an inability to achieve satisfactory electrochemical processing of the microfeature workpieces and/or require time consuming and costly steps to bring the processing fluids back into specification.

Another drawback of placing the electrochemical deposition chamber in an idle state without an electric potential present is that organic additives may break down at the nonporous barrier. Such additive breakdown is undesirable because it increases the rate of consumption of the expensive organic additives and introduces undesirable breakdown products into the processing fluids. In addition, steps must be taken to account for the change in additive concentration resulting from the additive breakdown.

SUMMARY OF THE INVENTION

The present invention is directed toward processes for electrochemically treating a surface of a microelectronic workpiece in an electrochemical treating chamber that address processing fluids drifting out of process specifications during an idle stage when an electric potential is not provided between a working electrode and a counterelectrode. Processes carried out in accordance with the present invention enable microfeature workpiece processors to maintain the processing fluids within their processing specifications during idle stages without the need for steps that require the electrochemical treating chamber to be unavailable for productive use. In addition, when processes carried out in accordance with the present invention are used, little or no breakdown of organic components at the ion-permeable barrier occurs. The present invention is useful in processes for electrochemically treating a surface of a workpiece to deposit metal ions from processing fluids onto the surface of the microfeature workpiece. The present invention is not limited to a specific electrochemical treatment process or to any specific metal ions, with copper, gold, silver, platinum, nickel, metal alloys, and solder being examples of suitable metals. Electroplating, electrophoretic deposition, electroetching, electropolishing, anodization and electroless plating procedures are examples of electrochemical treatment processes that can benefit from the present invention.

In accordance with the present invention, a process for electrochemically treating a surface of a plurality of microfeature workpieces in an electrochemical treating chamber that includes an ion-permeable barrier separating a first processing fluid from a second processing fluid includes a step of preventing transfer of processing fluid components between the first processing fluid and the second processing fluid during an idle stage. When the transfer of processing fluid components is prevented, the transfer of ionic species across the ion-permeable barrier during the idle stage that can cause the composition of the processing fluids to no longer satisfy the process specifications is avoided. Since this step of preventing the transfer of processing fluid components across the ion-permeable barrier is carried out during the idle stage, it does not occupy otherwise productive time for the electrochemical treating process.

In a specific embodiment, the prevention of transfer of processing fluid components between the first processing fluid and the second processing fluid during the idle stage can be accomplished by removing one of the processing fluids from contact with the ion-permeable barrier during an idle stage.

Processes of the present invention can be carried out using a system for electrochemically treating a microfeature workpiece that includes a flow control system for controlling the circulation of a first processing fluid or a second processing fluid such that a processing fluid can be caused to separate from the ion-permeable barrier during an idle stage. Use of processes and chambers formed in accordance with the present invention provides microfeature workpiece processors with a way to maintain the composition of processing fluids within process specifications during an idle stage without occupying otherwise productive time.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

As used herein, the terms "microfeature workpiece" or "workpiece" refer to substrates on and/or in which microdevices are formed. Typical microdevices include microelectronic circuits or components, thin film recording heads, data storage elements, micro fluidic devices, and other products. Micro machines or micro mechanical devices are included within this definition because they are manufactured using much of the same technology as used in the fabrication of integrated circuits. The substrates can be semiconductive pieces (e.g., silicon wafers or gallium arsenide wafers), nonconductive pieces (e.g., various ceramic substrates), or conductive pieces (e.g., doped wafers). Also, the term electrochemical processing includes electroplating, electrophoretic deposition, electroetching, electropolishing, anodization, and/or electroless plating.

In the description that follows, specific reference is made to copper as an example of a metal ion that can be electroplated onto a microfeature workpiece. The reference to copper ions is for exemplary purposes and it should be understood that the present invention is not limited to copper. Furthermore, the reference to electroplating is for exemplary purposes and it should be understood that the present invention in not limited to electroplating processes. The present invention is useful with metals in addition to copper as well as electrochemical processes other than electroplating.

Figure 1:
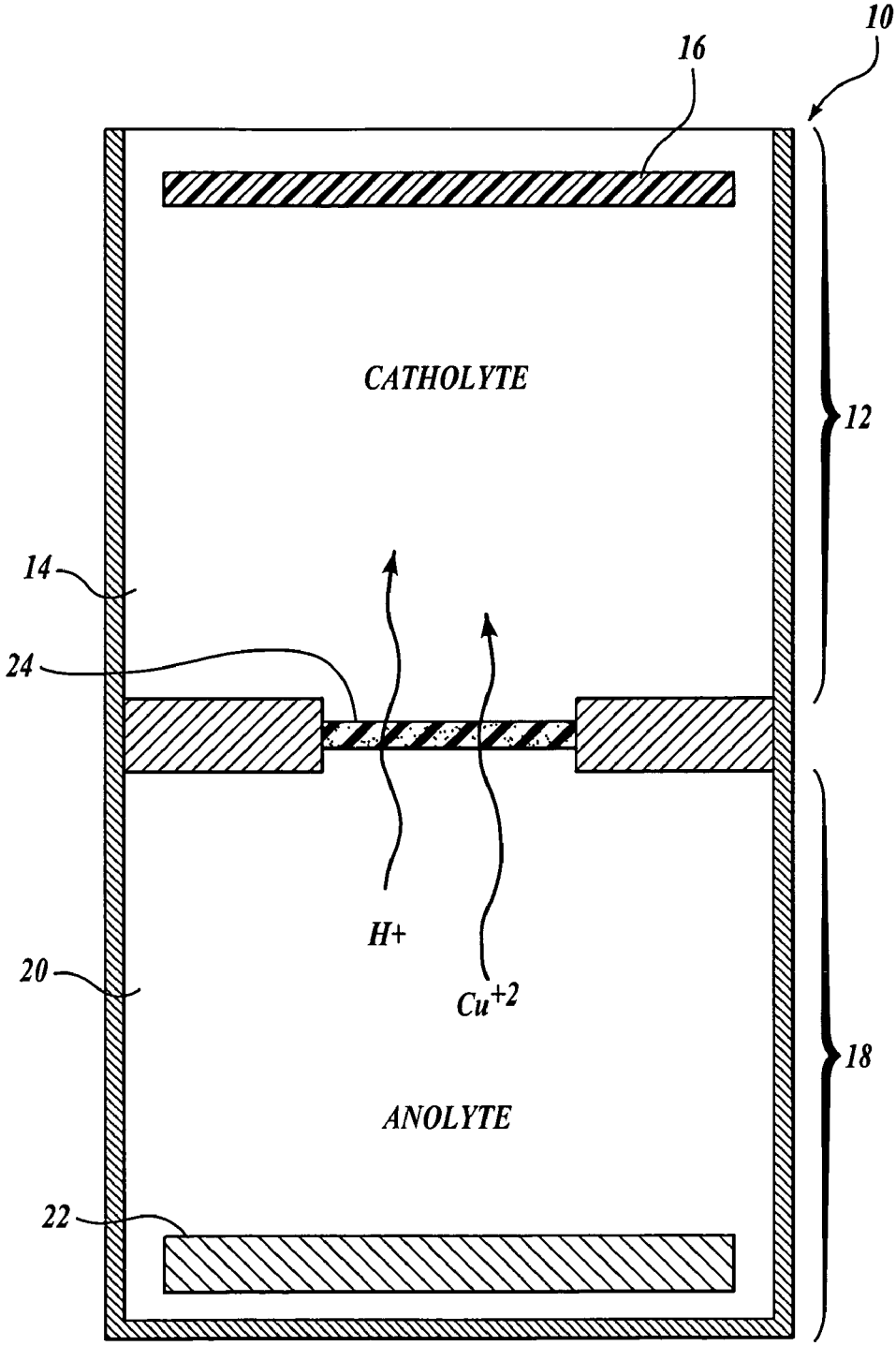
Fig.1. (PRIOR ART)
FIG. 1 is a schematic diagram of an electroplating chamber in accordance with the prior art.
Figure 2:
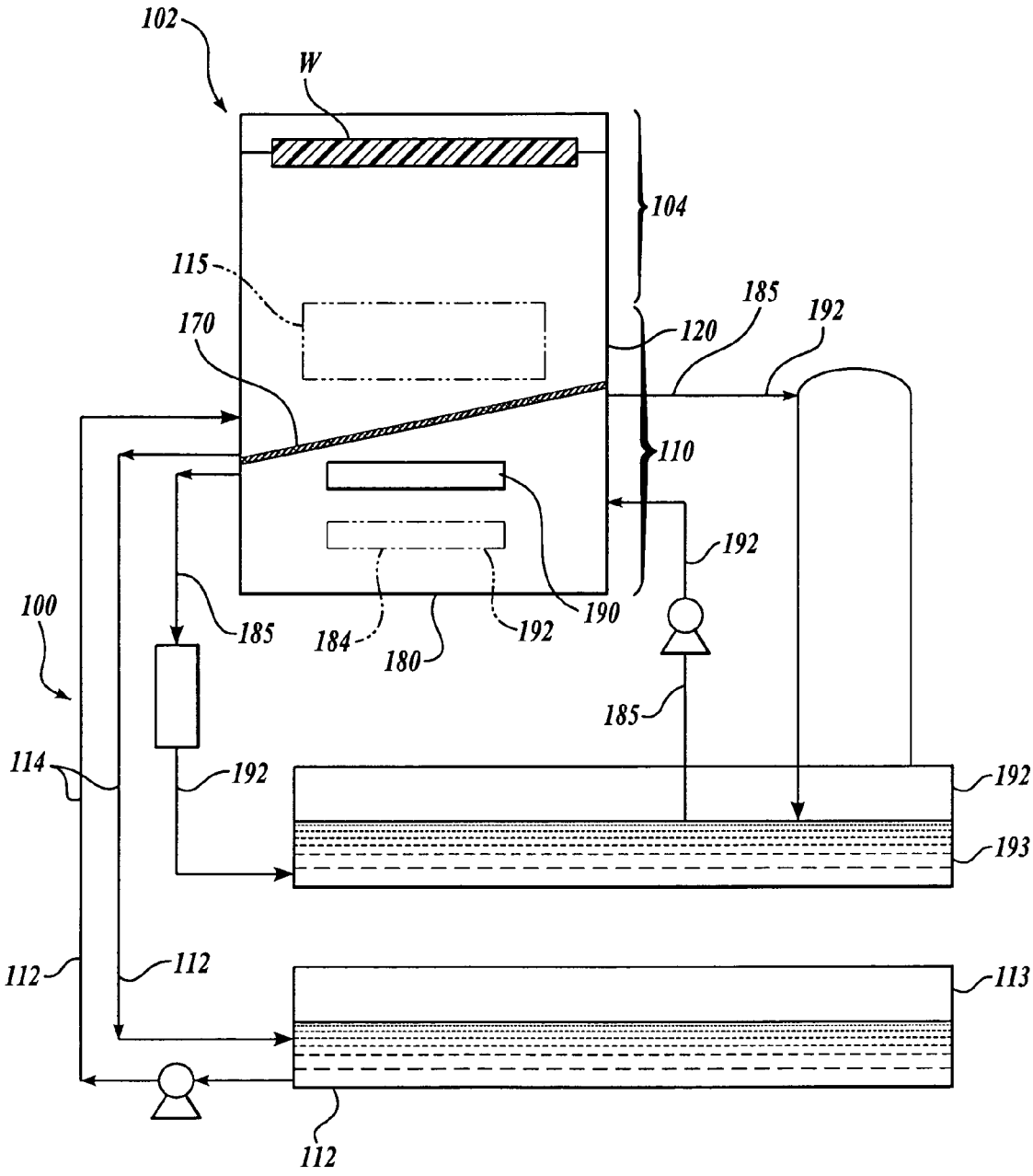
FIG. 2 is a schematic illustration of a system for electrochemically treating a microfeature workpiece formed in accordance with the present invention.

FIG. 2 schematically illustrates a system 100 for electrochemical deposition, electropolishing, or other wet chemical processing of microfeature workpieces. The system 100 includes an electrochemical deposition chamber 102 having a head assembly 104 (shown schematically) and a wet chemical vessel 110 (shown schematically). The head assembly 104 loads, unloads, and positions a workpiece W or a batch of workpieces at a processing site relative to the vessel 110. The head assembly 104 typically includes a workpiece holder having a contact assembly with a plurality of electrical contacts configured to engage a conductive layer on the workpiece W. The workpiece holder can accordingly apply an electrical potential to the conductive layer on the workpiece W. Suitable head assemblies, workpiece holders, and contact assemblies are disclosed in U.S. Pat. Nos. 6,228,232; 6,280,583; 6,303,010; 6,309,520; 6,309,524; 6,471,913; 6,527,925; 6,569,297; 6,780,374; and 6,773.560.

The illustrated vessel 110 includes a processing unit 120 (shown schematically), an electrode unit 180 (shown schematically), and an ion-permeable barrier 170 (shown schematically) between the processing and electrode units 120 and 180. The processing unit 120 is configured to contain a first processing fluid for processing the microfeature workpiece W. The electrode unit 180 is configured to contain an electrode 190 and a second processing fluid at least proximate to the electrode 190. The second processing fluid is generally different than the first processing fluid, but they can be the same in some applications. In general, the first and second processing fluids have some ions in common. For example, the first processing fluid in the processing unit 120 is a catholyte and the second processing fluid in the electrode unit 180 is an anolyte when the workpiece is cathodic. In electropolishing or other deposition processes, however, the first processing fluid can be an anolyte and the second processing fluid can be a catholyte.

System 100 further includes a first flow system 112 that stores and circulates the first processing fluid and a second flow system 192 that stores and circulates the second processing fluid. The first flow system 112 may include a first processing fluid reservoir 113, a plurality of fluid conduits 114 to convey a flow of the first processing fluid between the first processing fluid reservoir 113 and the processing unit 120. A plurality of components 115 (shown schematically) in processing unit 120 are used to convey a flow of the first processing fluid to the processing site. First flow system 112 delivers first processing fluid to processing unit 120 without passing it through electrode unit 180. When first processing fluid does not pass through electrode unit 180, the risk of leakage of first processing fluid from first flow system 112 into electrode unit 180 is avoided. Continuing to refer to FIG. 2, first processing fluid is delivered directly to processing unit 120 by having the inlet of a conduit 114 from first processing fluid reservoir 113 enter directly into processing unit 120 above barrier 170.

The second flow system 192 may include a second processing fluid reservoir 193, a plurality of fluid conduits 185 to convey the flow of the second processing fluid between the second processing fluid reservoir 193 and the electrode unit 180, and a plurality of components 184 (shown schematically) in the electrode unit 180 to convey the flow of the second processing fluid across the electrode 190. The concentrations of individual constituents of the first and second processing fluids can be controlled separately in the first and second processing fluid reservoirs 113 and 193, respectively. For example, metals ions, such as copper ions, can be added to the first and/or second processing fluid in the respective reservoir 113 or 193. Additionally, the temperature of the first and second processing fluids and/or removal of undesirable materials or bubbles can be controlled separately in the first and second flow systems 112 and 192.

Ion-permeable barrier 170 is positioned between the first and second processing fluids in the region of the interface between the processing unit 120 and the electrode unit 180 to separate the first processing fluid from the second processing fluid. For example, ion-permeable barrier 170 inhibits fluid flow between the first and second flow systems 112 and 192 while selectively allowing ions, such as cations or anions, to pass through the ion-permeable barrier 170 between the first and second processing fluids. As such, an electrical field, a charge imbalance between the processing fluids, and/or differences in the concentration of components in the processing fluids can drive ions across the barrier 170 as described in detail below.

Barrier 170 is an ion-permeable barrier, one example of which is a nonporous barrier, such as a semi-permeable ion exchange membrane. A semi-permeable ion exchange membrane allows cations or anions to pass but not both. A nonporous barrier inhibits fluid flow between the first processing fluid and the second processing fluid within chamber 102 while selectively allowing ions, such as cations or anions, to pass through the ion-permeable barrier, and between the first and second processing fluids. Accordingly, an electric potential, a charge imbalance between the processing fluids, and/or differences in the concentrations of substances in the processing fluids can drive ions across the ion-permeable barrier 170. In comparison to porous barriers, nonporous barriers are characterized by having little or no porosity or open space. In addition, in a normal electroplating chamber, nonporous barriers generally do not permit fluid flow when the pressure differential across the barrier is less than about 6 psi.

In contrast to porous barriers, such as filter media, expanded Teflon (Goretex), and fritted materials (glass, quartz, ceramic, etc.), a nonporous barrier substantially inhibits nonionic species, including small molecules and fluids, from passing through the barrier. Because the nonporous barriers are substantially free of open area, fluid is inhibited from passing through the nonporous barrier when the first and second flow systems operate at typical pressures. Water, however, can be transported through the nonporous barrier via osmosis and/or electro-osmosis. Osmosis can occur when the molar concentrations in the first and second processing fluids are substantially different. Electro-osmosis can occur as water is carried through the nonporous barrier with current carrying ions in the form of a hydration sphere. When the first and second processing fluids have similar molar concentrations and no electrical current is passed through the processing fluids, fluid flow between the first and second processing fluids through the nonporous barrier is substantially prevented.

A nonporous barrier can be hydrophilic so that bubbles in the processing fluids do not cause portions of the barrier to dry, which reduces conductivity through the barrier. Suitable nonporous barriers include Nafion® membranes manufactured by DuPont®, Ionac® membranes manufactured by Sybron Chemicals Inc., and NeoSepta™ membranes manufactured by Tokuyuma.

As discussed above, the changes in acid ion and metal ion concentrations in the anolyte and catholyte during an idle stage can cause the composition of the anolyte and catholyte to no longer satisfy process of specifications. As described in more detail below, the present invention provides a system and process for maintaining the composition of the anolyte and catholyte within process specifications during an idle stage by substantially preventing the transfer of processing fluid components between the first processing fluid and the second processing fluid during the idle stage.

Transfer of processing fluid components between the first processing fluid and the second processing fluid during the idle stage can be substantially prevented in accordance with the present invention in a number of different ways. For example, as described below in more detail, processing fluids can be separated from the barrier layer during the idle stage to prevent transfer of components. Alternatively, process fluid flow, e.g., anolyte flow, can be stopped. In certain electrochemical treatment processes, stopping anolyte flow results in the elimination or reduction of processing fluid components transferring across the ion-permeable barrier. For example, with anolyte flow, processing fluid components in the anolyte will not be replenished. Stopping anolyte flow will also reduce pressure and fluid that can promote transfer of processing fluid components across ion-permeable barrier. The ion-permeable barrier can also be physically blocked or separated from the processing fluids in order to prevent transfer of processing fluid components during an idle stage.

Separation of processing fluids from the ion-permeable barrier can be achieved in a number of different ways. For example, the anolyte can be separated from the ion-permeable barrier, or the catholyte can be separated from the ion-permeable barrier. Separation of the catholyte or anolyte from the ion-permeable barrier is characterized by the absence of fluid contact between the ion-permeable barrier and the bulk fluid comprising the anolyte or catholyte. Separation can be achieved by forming an air or gas gap between the ion-permeable barrier and the processing fluid. Separation of a processing fluid from the ion-permeable barrier need not be for the entire idle stage. Predetermined periods of time less than the duration of the idle stage, e.g., about 30 seconds to 1 hour, can be set for separating the processing fluid from the ion-permeable barrier or a percentage of time every hour can be set as a standard for separating a processing fluid from the ion-permeable barrier during an idle stage.

During an idle stage when a processing fluid is separated from the ion-permeable barrier, it may be advantageous to periodically recontact the processing fluid with the ion-permeable barrier in order to allow acid ions to transfer across the ion-permeable barrier from the catholyte to the anolyte in an amount sufficient to prevent the pH of the anolyte from rising above a level where the anode begins to passivate. For example, when the anode is a copper anode, the pH of the anolyte is preferably maintained below about 4.0 in order to avoid undesirable passivation of the copper anode.

Figure 3:
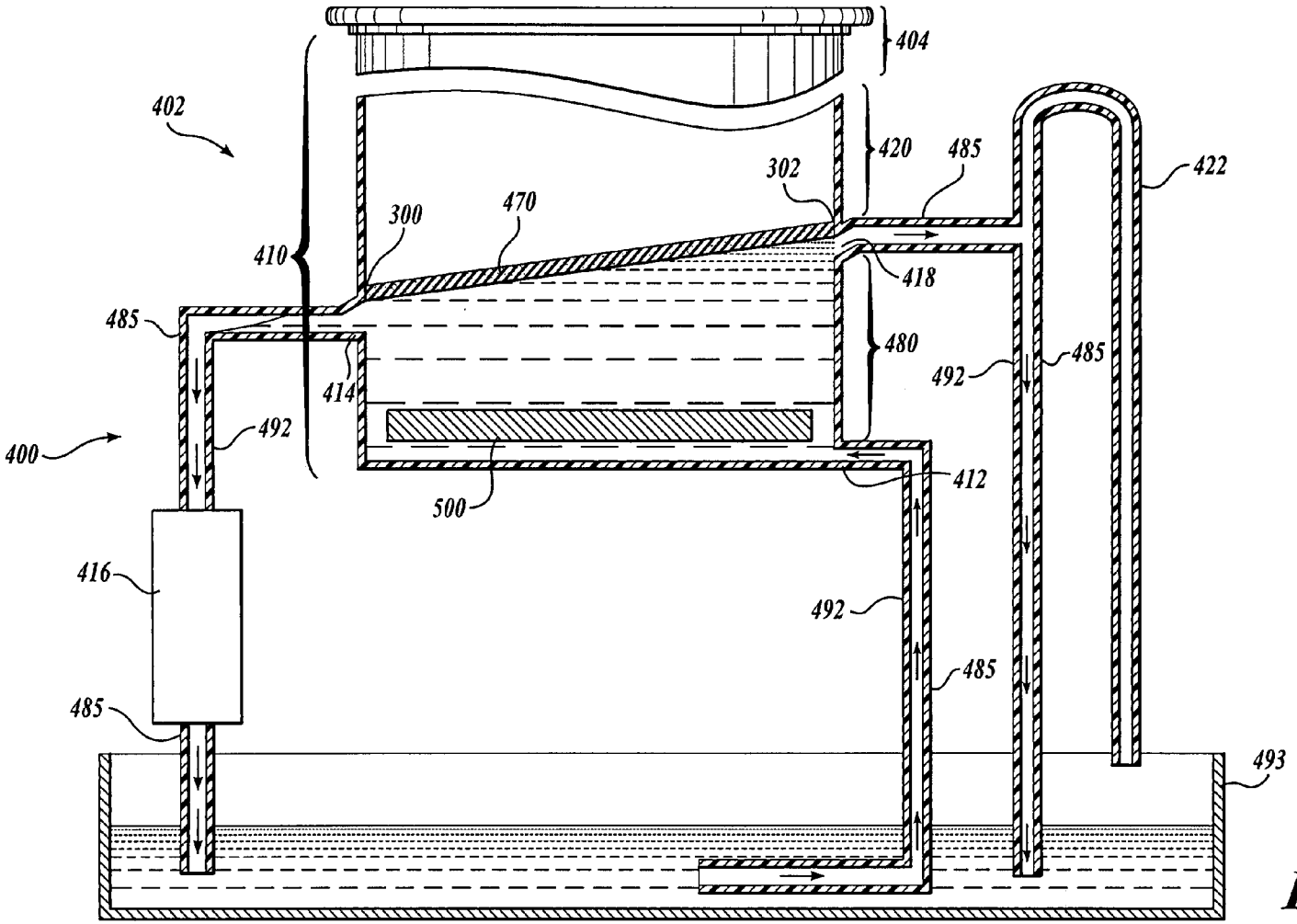
FIG. 3 is a schematic illustration of a system for electrochemically treating a microelectronic workpiece in a production stage in accordance with an embodiment of the present invention.
Figure 4:
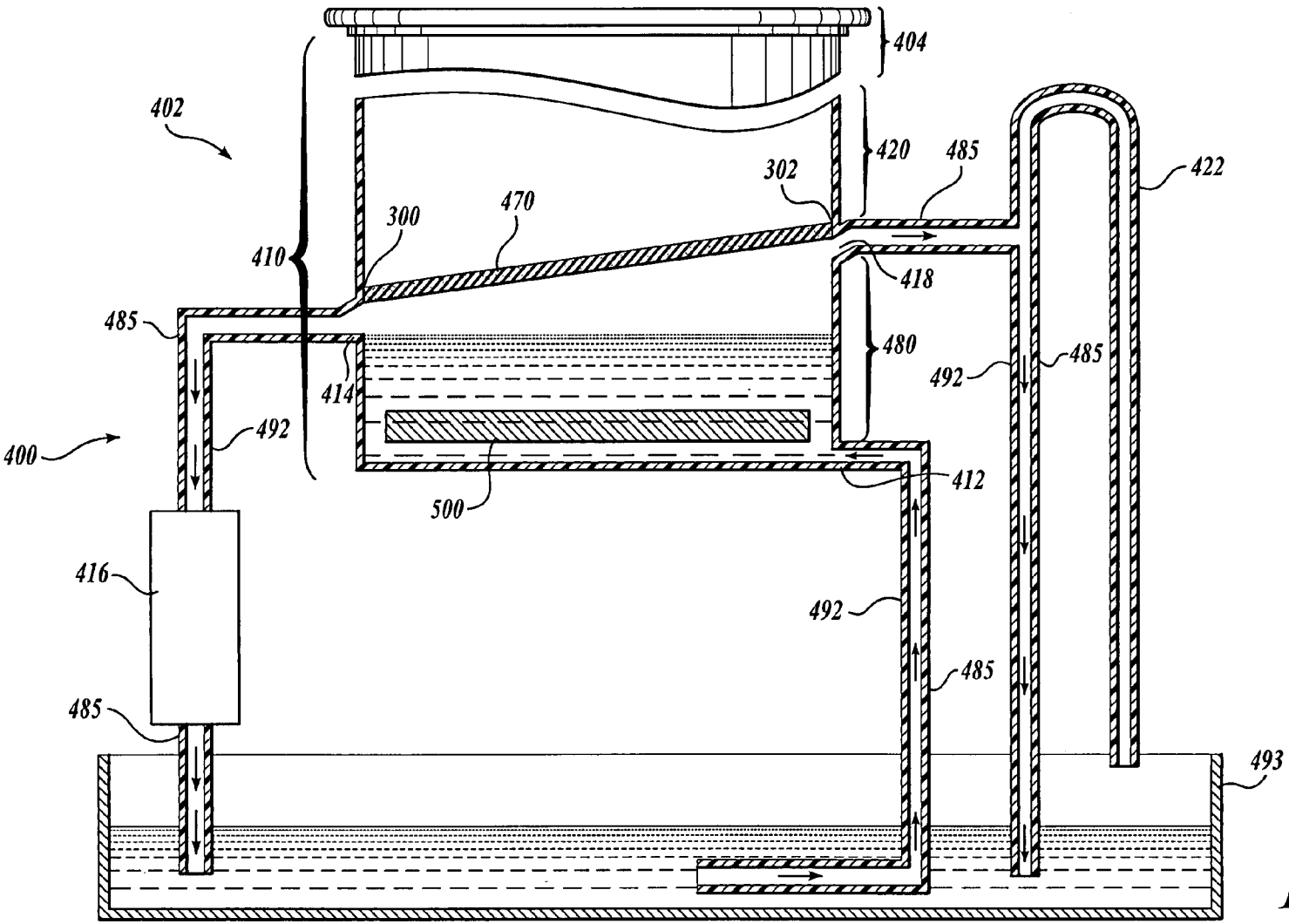
FIG. 4 is a schematic illustration of an idle stage for a system for electrochemically treating a microfeature workpiece in an idle stage in accordance with an embodiment of the present invention.

Referring to FIGS. 3 and 4, an exemplary configuration of an electrochemical treatment system 400 is illustrated and referred to in describing a process for preventing the transfer of processing fluid components between the first processing fluid and the second processing fluid during an idle stage and a system for achieving the same, formed in accordance with the present invention. It should be understood that FIGS. 3 and 4 illustrate one embodiment for preventing the component transfer but that the present invention is not necessarily limited to the specific embodiment illustrated in FIGS. 3 and 4.

Referring to FIG. 3, system 400 includes an electrochemical treatment chamber 402 that is schematically illustrated. Chamber 402 includes a head assembly 404 (shown schematically) and a wet chemical vessel 410 (illustrated schematically). Head assembly 404 loads, unloads, and positions a workpiece (not shown) or a batch of workpieces at a processing site relative to vessel 410. Head assembly 404 typically includes a workpiece holder having a contact assembly with a plurality of electrical contacts configured to engage a conductive layer on the workpiece. Vessel 410 includes a processing unit 420 (shown schematically), an electrode unit 480 (shown schematically), and an ion-permeable barrier 470 (shown schematically) between the processing unit 420 and the electrode unit 480. The processing unit 420 is configured to contain a first processing fluid for processing a microfeature workpiece. The electrode unit 480 is configured to contain an electrode 500 (shown schematically) and a second processing fluid at least proximate to the electrode. Electrode 500 can include a plurality of electrodes or an individual electrode. For purposes of the following discussion, the first processing fluid in processing unit 420 is a catholyte and the second processing fluid in the electrode unit 480 is an anolyte when the workpiece is cathodic. In electropolishing or other processes, the first processing fluid can be an anolyte and the second processing fluid can be a catholyte.

System 400 further includes a first processing fluid circulation system (not shown) for circulating a first processing fluid to the processing unit 420. The first processing fluid circulation system may be similar to the first flow system 112 described above with respect to FIG. 2.

System 400 further includes a second processing fluid circulation system 492 that includes a second processing fluid reservoir 493 and a plurality of fluid conduits 485 to direct the flow of the second processing fluid between the second processing fluid reservoir 493 and the electrode unit 480. Though not illustrated, electrode unit 480 can include a plurality of components to convey the flow of the second processing fluid over the electrode 500 in the electrode unit 480.

As illustrated, ion-permeable barrier 470 is positioned between the processing unit 420 and electrode unit 480 to separate the first and second processing fluids. In the illustrated embodiment, the ion-permeable barrier is inclined so that ion-permeable barrier 470 includes a lower peripheral edge 300 and an upper peripheral edge 302, opposite the lower peripheral edge 300.

In addition to the non-porous barriers described above, ion-permeable barrier 470 could also be a porous barrier.

Porous barriers include substantial amounts of open area or pores that permit fluid to pass through the porous barrier. Both ionic components and non-ionic components are capable of passing through a porous barrier; however, passage of certain components may be limited or restricted if the components are of a size that allows the porous barrier to inhibit the passage of such components. While porous barriers may limit the chemical transport (via diffusion and/or convection) of some components in the first processing fluid and the second processing fluid, they allow migration of anionic and cationic species (enhance passage of current) during application of electric fields associated with electrolytic processing. In the context of electrochemical processing wherein copper ions are present in the anolyte and catholyte, a porous barrier enables migration of ionic species, including copper ions, across the porous barrier while substantially limiting diffusion or mixing (i.e., transport across the barrier) of larger organic components between the anolyte and catholyte. The ionic species are driven across the porous barrier by migration (movement in response to the imposed electric field). Thus, porous barriers permit maintaining different chemical compositions for the anolyte and the catholyte. The porous barriers should be chemically compatible with the processing fluids over extended operational time periods. Examples of suitable porous barrier layers include porous glasses (e.g., glass frits made by sintering fine glass powder), porous ceramics (e.g., alumina and zirconia), silica aerogel, organic aerogels (e.g., resorcinol formaldehyde aerogel), and porous polymeric, materials, such as expanded Teflon® (Goretex®). Suitable porous ceramics include grade P-6-C available from Coorstek of Golden, Colo. An example of a suitable porous barrier is a porous plastic, such as Kynar, a sintered polyethylene or polypropylene. Such materials can have a porosity (Boyd fraction) of about 25%-85% by volume with average pore sizes ranging from about 0.5 to about 20 micrometers. Such porous plastic materials are available from Poretex Corporation of Fairbum, Ga. These porous plastics may be made from three separate layers of material that include a thin, small pore size material sandwiched between two thicker larger pore size sheets. An example of a product useful for the middle layer having small pore size is CelGard 2400, made by CelGuard Corporation, a division of Hoechst, of Charlotte, N.C. The outer layers of the sandwich construction can be a material such as ultrafine grade sintered polyethylene sheet, available from Poretex Corporation. The porous barrier materials allow fluid flow across themselves in response to the application of pressures normally encountered in an electrochemical treatment process, e.g., pressures normally ranging from about 6 psi and below.

Continuing to refer to FIGS. 3 and 4, electrode unit 480 includes a second processing fluid inlet 412 adjacent to its bottom. Second processing fluid inlet 412 is in fluid communication with second processing fluid reservoir 493 through fluid conduit 485. A fluid conduit 485 delivers second processing fluid from reservoir 493 to electrode unit 480 through second processing fluid inlet 412. Electrode unit 480 also includes a second processing fluid primary outlet 414. Second processing fluid primary outlet 414 is in fluid communication with second processing fluid reservoir 493 through fluid conduits 485. Second processing fluid primary outlet 414 is located in a position where processing fluid within electrode unit 480 can flow into second processing fluid primary outlet 414 when the second processing fluid is not in contact with the underside of ion-permeable barrier 470. In the illustrated embodiment, second processing fluid primary outlet 414 is located adjacent the underside of barrier 470 at the location where the lower peripheral edge 300 of ion-permeable barrier 470 contacts the wall of electrode unit 480.

Between second processing fluid primary outlet 414 and second processing fluid reservoir 493 is a flow control system 416 capable of adjusting the rate of flow of second processing fluid into second processing fluid primary outlet 414 and fluid conduit 485. A suitable flow control system includes an adjustable valve or metering device for increasing or decreasing the volume of flow.

Electrode unit 480 also includes a second processing fluid secondary outlet 418. The second processing fluid secondary outlet 418 is located in a position such that when second processing fluid contacts the entire undersurface of ion-permeable barrier 470, second processing fluid is able to flow through second processing fluid secondary outlet 418 and return to second processing reservoir 493. In the illustrated embodiment, second processing fluid secondary outlet 418 is located adjacent the underside of ion-permeable barrier 470 at the location where the upper peripheral edge 302 of ion-permeable barrier 470 contacts the wall of the electrode unit 480. Secondary processing fluid secondary outlet 418 is in fluid communication with second processing fluid reservoir 493 through conduit 485. Conduit 485 is vented to second processing fluid reservoir 493 through vent 422. The use of system 400 to separate a processing fluid from the ion-permeable barrier during an idle stage is described below in more detail.

FIG. 3 illustrates the level of processing fluid in the electrode unit 480 and processing unit 420 during a production stage. During the production stage, both the second processing fluid and the first processing fluid are in contact with barrier 470. As explained below, this contact allows for ionic components to transfer across the ion-permeable barrier. During the production stage, second processing fluid is delivered to electrode unit 480 through fluid conduits 485 and a constant flow of second processing fluid is provided to electrode unit 480. During a production stage, the second processing fluid is maintained in contact with ion-permeable barrier 470 by ensuring that the amount of second processing fluid entering electrode unit 480 is equal to or greater than the amount of second processing fluid that exits electrode unit through second processing fluid primary outlet 414. If the amount of second processing fluid entering electrode unit 480 through second processing fluid inlet 412 is equal to the amount of second processing fluid exiting primary outlet 414, no processing fluid flows through second processing fluid secondary outlet 418. On the other hand, when the flow of second processing unit into electrode unit 480 exceeds the amount of second processing fluid leaving electrode unit 480 through second processing fluid primary outlet 414, second processing fluid will also flow through second processing fluid secondary outlet 418 where it returns to second processing fluid reservoir 493.

The volume of second processing fluid flowing out of electrode unit 480 is controlled by controlling the flow of second processing fluid out of outlet 414. Such control is achieved using flow control system 416 to adjust the amount of second processing fluid leaving electrode unit 480 through flow through conduit 485.

In accordance with the present invention, once a production stage is complete, the electric potential between the workpiece and the anode is removed and production idled. Flow control system 416 is adjusted to allow for an increase in the flow rate of second processing fluid that exits electrode unit 480 through outlet 414 while flow of second processing fluid into electrode unit 480 remains the same. Referring to FIG. 5, this flow imbalance between the amount of second processing fluid entering electrode unit 480 and the amount exiting the electrode unit 480 results in the level of second processing fluid in electrode unit 480 dropping to a level such that it is removed from contact with the ion-permeable barrier 470. Alternatively, the flow of second processing fluid into electrode unit 480 can be reduced. Without contact between the second processing fluid and ion-permeable barrier 470, transfer of hydrogen ions and copper ions across the ion-permeable barrier that normally occurs during the idle stage does not occur.

This state of no contact between the second processing fluid and ion-permeable barrier 470 can be maintained during the entire idle stage, or as described above, the second processing fluid can be recontacted with the ion-permeable barrier 470 one or more times during the idle stage. Recontact of the second processing fluid with ion-permeable barrier 470 can be achieved by adjusting flow control system 416 to reduce the amount of second processing fluid leaving electrode unit 480 through second processing fluid primary outlet 414 so that the amount of second processing fluid leaving electrode unit 480 is less than the amount entering. This imbalance between the amount of processing fluid leaving electrode unit 480 and the amount of processing fluid entering electrode unit 480 causes the level of the processing fluid to rise until it comes into contact across the entire bottom surface of ion-permeable barrier 470. Once the second processing fluid has been recontacted with the underside of ion-permeable barrier 470, the flow control system 416 can be adjusted to increase the amount of second processing fluid leaving electrode unit 480 so that contact between the second processing fluid and ion-permeable barrier 470 can be maintained without a build up of unnecessary pressure. In order to further avoid the build up of unnecessary pressure, processing fluid is able to exit electrode unit 480 through second processing fluid secondary outlet 418. Once second processing fluid is recontacted with the underside of ion-permeable barrier 470, production can begin if appropriate, or the processing fluid can be separated from the ion-permeable barrier again before production is initiated.

Second processing fluid secondary outlet 418 is vented through vent 422 to the second processing fluid reservoir 493. Venting of second processing fluid secondary outlet 418 avoids the creation of a vacuum within electrode unit 480 when the level of second processing fluid is lowered in the future to remove it from contact with ion-permeable barrier 470.

During the idle stage, after the second processing fluid is removed from contact with the ion-permeable barrier 470, flow of the second processing fluid can be stopped, slowed, or, alternatively, it can be maintained. Maintaining flow of the second processing fluid is advantageous where such flow produces positive effects such as minimization of bubble formation, prevention of flaking of the anode, or drying out of the anode.

Referring back to FIG. 2, when the system 100 is used for electrochemical processing, an electric potential can be applied to the electrode 190 and the workpiece W such that the electrode 190 is an anode and the workpiece W is a cathode. The first and second processing fluids are accordingly a catholyte and an anolyte, respectively, and each fluid can include a solution of metal ions to be plated onto the workpiece W. The electric field between the electrode 190 and the workpiece W will drive positive ions through the barrier 170 from the anolyte to the catholyte, or drive negative ions in the opposite direction. In plating applications, an electrochemical reaction occurs at the microfeature workpiece W in which metal ions are reduced to form a solid layer of metal on the microfeature workpiece W. In electrochemical etching, electropolishing, or anodization and other electrochemical applications, the electrical field may drive ions the opposite direction.

As explained above, one feature of system 100 illustrated in FIG. 2 is that ion-permeable barrier 170 separates and substantially prevents the first processing fluid or its organic components from intermixing with the second processing fluid or vice versa, but allows ionic components to pass between the first and second processing fluids. As such, the fluid in the processing unit 120 can have different chemical characteristics than the fluid in the electrode unit 180. For example, the first processing fluid can be a catholyte having organic components and the second processing fluid can be an anolyte without organic additives or a much lower concentration of such additives. In addition, the catholyte and anolyte can have different concentrations of ionic components such as metal ions and acid ions.

System 100 illustrated in FIG. 2 is effective in maintaining the desired concentration of copper ions or other metal ions in the first processing fluid. During an electroplating process, it is desirable to accurately control the concentration of materials in the first processing fluid to ensure consistent, repeatable depositions on a large number of individual microfeature workpieces. For example, when copper is deposited on the workpiece W, it is desirable to maintain the concentration of copper ions in the first processing fluid (e.g., the catholyte) within a desired range to deposit a suitable layer of copper on the workpiece W.

To control the concentration of metal ions in the first processing solution in some electroplating applications, system 100 illustrated in FIG. 2 may rely upon characteristics of the ion-permeable barrier 170, the volume of the first flow system 112, the volume of the second flow system 192, and the different acid concentrations in the first and second processing solutions. For example, in the embodiment illustrated in FIG. 2 using a non-porous barrier, the concentration of acid in the first processing fluid is greater than the concentration of acid in the second processing fluid, and the volume of the first processing fluid in the system 100 is greater than the volume of the second processing fluid in the system 100. These features work together to maintain the concentration of the components in the first processing fluid within a desired range to ensure consistent and uniform deposition on the workpiece W.

The foregoing operation of the system 100 shown in FIG. 2 occurs, in part, by selecting suitable concentrations of ionic processing fluid components, hydrogen ions (i.e., acid protons) and copper ions. In several useful processes for depositing copper, the acid concentration in the first processing fluid can be approximately 5 g/l to approximately 200 g/l, and the acid concentration in the second processing fluid can be approximately 0.01 g/l to approximately 10.0 g/l or a pH of about 1 to 4. Alternatively, the acid concentration of the first and/or second processing fluids can be outside of these ranges. For example, the first processing fluid can have a first concentration of acid and the second processing fluid can have a second concentration of acid less than the first concentration. The ratio of the first concentration of acid to the second concentration of acid, for example, can be approximately 10:1 to approximately 20,000:1. The concentration of copper is also a parameter. For example, in many copper plating applications, the first and second processing fluids can have a copper concentration of between approximately 10 g/l and approximately 50 g/l.

When the first processing fluid is a catholyte, the first processing fluid can be characterized as a "high acid" catholyte bath. A high acid catholyte bath may include about 120-200 g/l acid concentration and about 10-40 g/l copper ion concentration. The first processing fluid can also be a catholyte that contains less acid and can be characterized as a "moderate acid" catholyte. A moderate acid catholyte can include about 45-120 g/l acid concentration and about 40-50 g/l copper ion concentration. The first processing fluid can have even less acid and be characterized as a "low acid" catholyte. A low acid catholyte can include about 5 g/l-45 g/l acid concentration and about 40-50 g/l copper ion concentration. In addition, these types of baths may include small amounts, e.g., about 10-100 ppm hydrochloric acid.

When the second processing fluid is an anolyte, it may comprise about 0.01-10 g/l acid concentration and about 10-50 g/l copper ion concentration which results in a pH between about 1-4. A narrower range of acid concentration for an anolyte is about 0.1-1.0 g/l. Like the catholyte, the anolyte may include about 10-100 ppm hydrochloric acid. Although the foregoing ranges are useful for many applications, it will be appreciated that the first and second processing fluids can have other concentrations of copper and/or acid.

In other embodiments, ion-permeable barrier 170 can be anionic and electrode 190 in FIG. 2 can be an inert anode (i.e., platinum or iridium oxide) to prevent the accumulation of sulfate ions in the first processing fluid. In these embodiments, the acid concentration or pH in the first and second processing fluids can be similar. Alternatively, the second processing fluid may have a higher concentration of acid to increase the conductivity of the fluid. Copper salt (e.g., copper sulfate) can be added to the first processing fluid to replenish the copper in the fluid. Electric current can be carried through the ion-permeable barrier by the passage of sulfate anions from the first processing fluid to the second processing fluid. Therefore, sulfate ions are less likely to accumulate in the first processing fluid where they can adversely affect the deposited film.

In other embodiments, the system can electrochemically etch copper from the workpiece. In these embodiments, the first processing solution (the anolyte) contains an electrolyte that may include copper ions. During electrochemical etching, a potential can be applied to the electrode and the workpiece. The ion-permeable barrier is chosen to prevent positive ions (such as copper) from passing into the second processing fluid (catholyte). Consequently, the current is carried by anions, and copper ions are inhibited from flowing proximate to and being deposited on the electrode.

The foregoing operation of the illustrated system 100 also occurs by selecting suitable volumes of anolyte and catholyte. Referring back to FIG. 2, another feature of the illustrated system 100 is that it has a first volume of the first processing fluid and a second volume of the second processing fluid in the corresponding processing fluid reservoirs 113 and 193 and flow systems 112 and 192. The ratio between the first volume and the second volume can be approximately 1.5:1 to 20:1, and in many applications is approximately 2:1, 3:1, 4:1, 5:1, 6:1, 7:1, 8:1, 9:1 or 10:1. The difference in volume in the first and second processing fluids moderates the change in the concentration of materials in the first processing fluid. For example, as described below with reference to FIGS. 5A and 5B, when hydrogen ions move from the anolyte to the catholyte, the percentage change in the concentration of hydrogen ions in the catholyte is less than the change in the concentration of hydrogen ions in the anolyte because the volume of catholyte is greater than the volume of anolyte. In other embodiments, the first and second volumes can be approximately the same. When porous barriers are employed, the volumes of the first processing fluid and second processing fluid may differ from the volumes used when the barrier is non-porous, e.g., larger volumes may be needed when porous barriers are employed.

FIGS. 5A-5H graphically illustrate the relationship between the concentrations of hydrogen and copper ions in the anolyte and catholyte for system 100 during a production stage and during an idle stage. The following description regarding FIGS. 5A-5H, more specifically, describes several embodiments of operating the system 100 shown in FIG. 2.

Figure 5A:
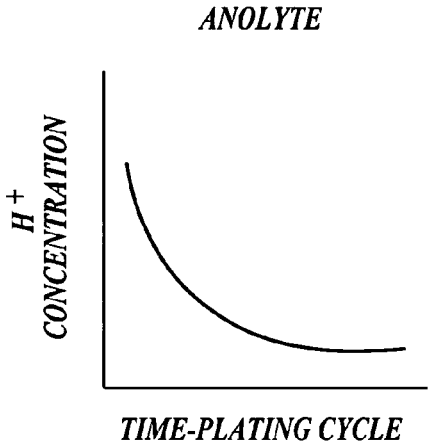
FIGS. 5A-5H graphically illustrate the relationship between the concentration of hydrogen ions and copper ions in an anolyte and a catholyte during a plating stage and during an idle stage using the chamber of FIG. 1.
Figure 5B:
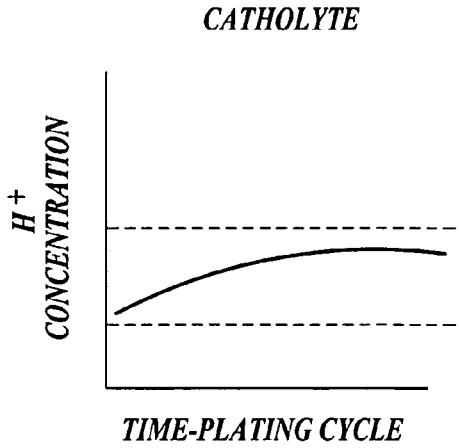

FIGS. 5A and 5B illustrate the change in concentration of hydrogen ions in the second processing fluid (anolyte) and the first processing fluid (catholyte), respectively, during a production stage. The electric field drives hydrogen ions across barrier 170 (FIG. 2) from the anolyte to the catholyte during the production stage. Consequently, the concentration of hydrogen ions decreases in the anolyte and increases in the catholyte. As measured by percent concentration change or molarity, the decrease in the concentration of hydrogen ions in the anolyte is generally significantly greater than the corresponding increase in the concentration of hydrogen ions in the catholyte because: (a) the volume of catholyte in the illustrated system 100 is greater than the volume of anolyte; and (b) the concentration of hydrogen ions in the catholyte is much higher than in the anolyte.

Figure 5C:
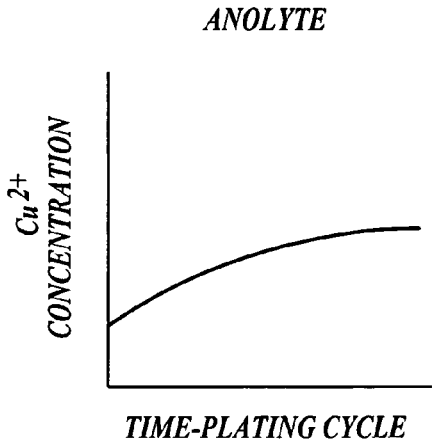
Figure 5D:
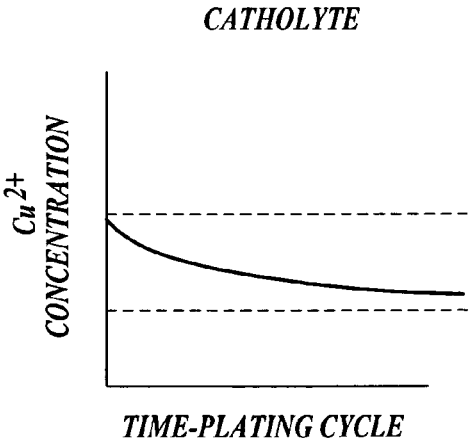

FIGS. 5C and 5D graphically illustrate the change in concentration of copper ions in the anolyte and catholyte during the production stage. During the production stage, the anode replenishes copper ions in the anolyte and the electrical field drives the copper ions across the barrier 170 from the anolyte to the catholyte. Thus, as shown in FIG. 5C, the concentration of copper ions in the anolyte increases during the production stage. Conversely, in the catholyte cell, FIG. 5D shows that the concentration of copper ions in the catholyte initially decreases during the production stage as the copper ions are consumed to form a layer on the microfeature workpiece W.

The dotted lines in FIGS. 5B and 5C illustrate the range of hydrogen ion concentration and copper ion concentration for the catholyte as defined by the process specification. FIGS. 5B and 5C illustrate how during the production cycle, the hydrogen ion and copper ion concentration of the catholyte is maintained within the process specifications.

Figure 5E:
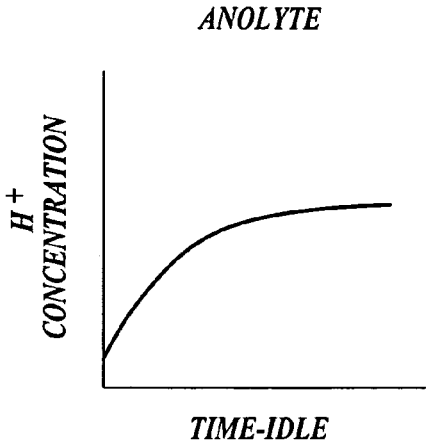
Figure 5F:
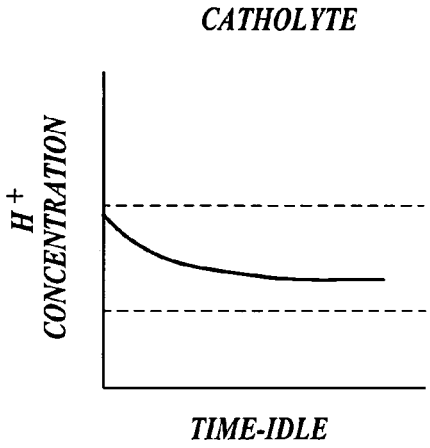
Figure 5G:
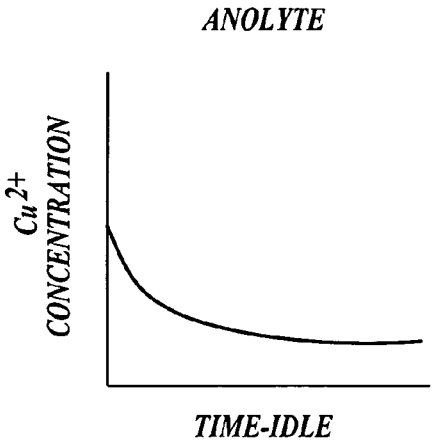
Figure 5H:
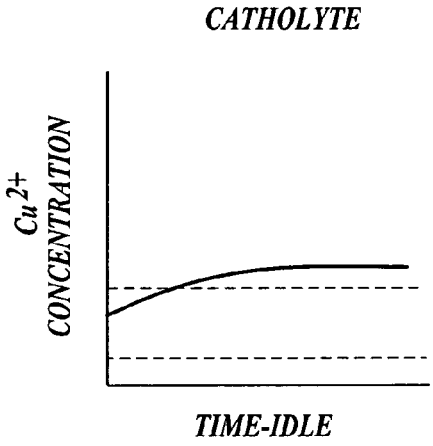

FIGS. 5E-5H graphically illustrate the change in concentration of hydrogen and copper ions in the anolyte and the catholyte while system 100 of FIG. 2 is idle. For example, FIGS. 5E and 5F illustrate that the concentration of hydrogen ions increases in the anolyte and decreases in the catholyte while the system 100 is idle because the greater concentration of acid in the catholyte drives hydrogen ions across the barrier 170 to the anolyte. FIGS. 5G and 5H graphically illustrate that the concentration of copper ions decreases in the anolyte and increases in the catholyte while the system 100 is idle because the movement of hydrogen ions into the anolyte creates a charge imbalance that drives copper ions from the anolyte to the catholyte. The dotted lines in FIGS. 5F and 5H illustrate the range of the hydrogen ion concentration and the copper ion concentration for the catholyte as defined by the process specification. FIGS. 5F and 5H illustrate how during an idle stage, the copper ion concentration in the catholyte drifts outside of the process specification.

It has been observed that when a processing fluid is removed from the ion-permeable barrier, breakdown of organic additives that had been observed to occur during an idle stage, no longer occurs. By avoiding the undesirable breakdown of the organic additives, introduction of undesirable byproducts into the processing fluid and unnecessary consumption of the organic additives is avoided. These advantages will improve the effectiveness of the electrochemical treatment process as well as reduce the cost associated with replacing the decomposed organic additives.

While separation of a processing fluid from a barrier during an idle stage has been described above in the context of removing a second processing fluid which is an anolyte from the ion-permeable barrier, it should be understood that similar benefits could be achieved by removing the catholyte from contact with the barrier. In addition, it should be understood that one skilled in the art could prevent transfer of processing fluid components between the first processing fluid and the second processing fluid during an idle stage in different ways while still achieving the object of maintaining the composition of the first processing fluid and second processing fluid within process specifications. For example, it should be understood that separation of a processing fluid from the barrier could be achieved using a system that is different from the system described with reference to FIGS. 4 and 5.

Figure 6:
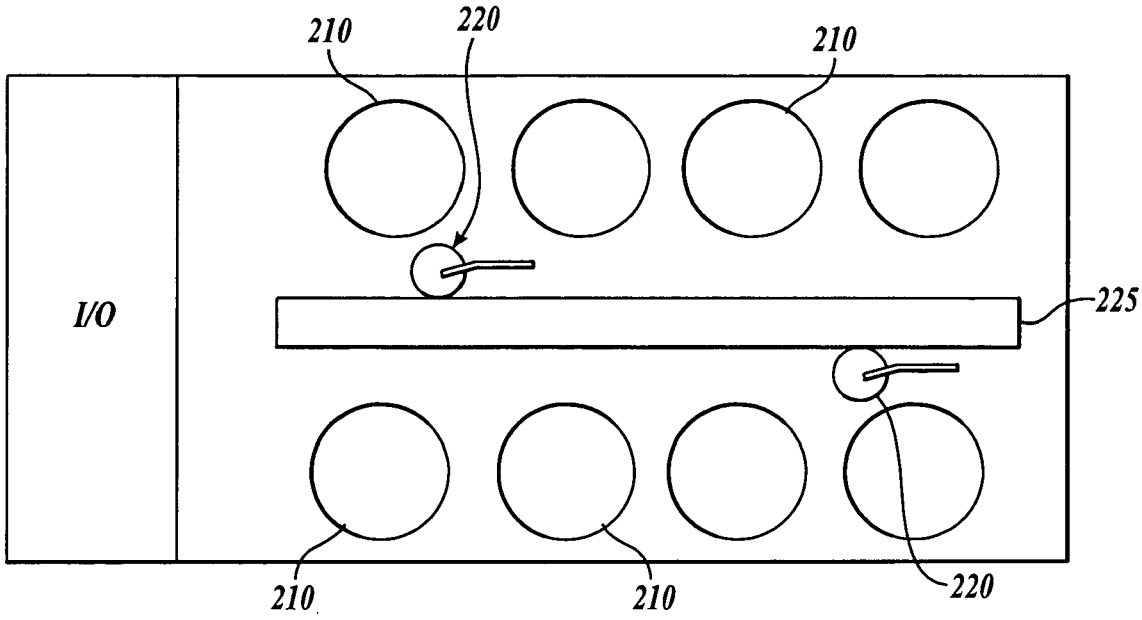
FIG. 6 is a schematic illustration of a tool that includes a system for electrochemically treating a microfeature workpiece in accordance with the present invention.

One or more of the chambers for electrochemically treating a microfeature workpiece or systems including such chambers may be integrated into a processing tool that is capable of executing a plurality of methods on a workpiece. One such processing tool is an electroplating apparatus available from Semitool, Inc., of Kalispell, Mont. Referring to FIG. 6, such a processing tool may include a plurality of processing stations 210, one or more of which may include a chamber for electrochemically treating a microfeature workpiece formed in accordance with the present invention. Other suitable processing stations include one or more rinsing/drying stations and other stations for carrying out wet chemical processing. The tool also includes a robotic member 220 that is carried on a central track 225 for delivering workpieces from an input/output location to the various processing stations.

While a preferred embodiment of the invention has been illustrated and described, it will be appreciated that various changes can be made therein without departing from the spirit and scope of the invention.

The embodiments of the invention in which an exclusive property or privilege is claimed are defined as follows:

1. A system for electrochemically treating a microfeature workpiece comprising:

a chamber including:

a processing unit for receiving a first processing fluid;

an electrode unit for receiving a second processing fluid;

an ion-permeable barrier between the processing unit and the electrode unit;

a first processing fluid circulation system;

a second processing fluid circulation system; and a flow control system controlling the first processing fluid circulation system or the second processing fluid circulation system to cause processing fluid to separate from the barrier during an idle stage between a first electrochemical treatment stage and a second electrochemical treatment stage.

2. The system of claim 1, wherein the flow control system controls the first processing fluid circulation system or the second processing fluid circulation system to cause processing fluid separated from the ion-permeable barrier during the idle stage to contact the barrier during the idle stage.

3. The system of claim 1, wherein the electrode unit of the chamber includes an anolyte inlet, first anolyte outlet spaced above the anolyte inlet, and a second anolyte outlet spaced above the first anolyte outlet.

4. The system of claim 3, wherein the first anolyte outlet is in fluid communication with a source of anolyte.

5. The system of claim 4, further comprising a flow control device between the first anolyte outlet and the source of anolyte.

6. The system of claim 3, wherein the anolyte inlet is in fluid communication with a source of anolyte.

7. The system of claim 3, wherein the second anolyte outlet is in fluid communication with a source of anolyte.

* * * * *

UNITED STATES PATENT AND TRADEMARK OFFICE

CERTIFICATE OF CORRECTION

PATENT NO. : 7,628,898 B2
APPLICATION NO. : 11/198905
DATED : December 8, 2009
INVENTOR(S) : Klocke et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1160 days.

Signed and Sealed this

Second Day of November, 2010

David J. Kappos

David J. Kappos
*Director of the United States Patent and Trademark Office*